United States Patent [19]

Hunter

[11] 4,052,248

[45] Oct. 4, 1977

[54] PAPER DISPENSING APPARATUS FOR ROLLS OF PAPER

[75] Inventor: Travis Lowell Hunter, La Verne, Calif.

[73] Assignee: Travis Hunter, Montclair, Calif.

[21] Appl. No.: 626,966

[22] Filed: Oct. 29, 1975

[51] Int. Cl.[2] ..... B31F 5/08; B32B 31/18

[52] U.S. Cl. ..... 156/511; 156/554; 225/38

[58] Field of Search ..... 225/34, 37, 38, 77, 225/79, 84, 85, 89-92; 156/527, 554, 577, 511; 242/55.3, 73, 71.9, 134, 139

[56] References Cited

U.S. PATENT DOCUMENTS

| | | | |
|---|---|---|---|
| 436,789 | 9/1890 | Jobes | 225/85 X |
| 838,517 | 12/1906 | Bowser | 225/38X |
| 908,313 | 12/1908 | Nelson | 225/38 |
| 1,606,774 | 11/1926 | Nelson | 225/90 X |
| 3,602,457 | 8/1971 | Nichols et al. | 242/134 |
| 3,787,271 | 1/1974 | Wahlquist | 156/554 |
| 3,847,709 | 11/1974 | Martin | 156/554 X |
| Re. 23,542 | 9/1952 | Bihary | 156/554 |

*Primary Examiner*—Frank T. Yost
*Attorney, Agent, or Firm*—Jackson & Jones Law Corporation

[57] ABSTRACT

A paper dispensing apparatus includes a base member having a stand and a pair of wheels and a support member attached to the base member. A plurality of shafts extend outward from the support member to respectively support different widths of paper rolls. A handle can be attached to the support member to assist manipulation of the apparatus by an operator. Cutting bars can extend either in a cantilevered fashion adjacent the respective paper rolls or be attached at either end of the respective shaft. A pressure bar can hold the paper roll and assist in applying masking tape from an adjacent masking roll support member. Extension tubes are provided for adjusting the length of a shaft to accommodate a paper roll greater in width than that of the shaft length. As an alternative embodiment, a hand-carried single shaft dispenser is also disclosed.

10 Claims, 3 Drawing Figures

PAPER DISPENSING APPARATUS FOR ROLLS OF PAPER

BACKGROUND OF THE INVENTION

1. Field of the Invention

The present invention is directed broadly at the dispensing of an adhesive masked paper, or apron, and more particularly, at the dispensing of paper from a hand-carried, or pulled, dispenser apparatus capable of accommodating different size rolls of paper.

2. Description of the Prior Art

The use of strips of paper having adhesive tape along one edge has been known in the prior art for a long period of time. Particularly, in the automobile repair industry, it has been known to utilize sheets of adhesive paper to protect, or mask, various portions of a vehicle body to prevent paint from getting on select areas of the vehicle body when it is applied to adjacent surfaces of the car. The adhesive stripped paper has been particularly desirable in that it is capable of a quick and easy application, and also, of a quick and easy removal without leaving any mark, or substance, on the protected surface of the vehicle. An early example of this use can be found in the De Lillo U.S. Pat. No. 2,210,233. While the advantages of these adhesive tape sheets of paper have been well known and have been frequently referred to as an apron, the specific dispensing of the material has frequently required relatively expensive and cumbersome mechanism that had a limited capability.

One commercial masker, or apron taper stand, has been sold in the form of a cart with a pair of horizontal supports for various sizes of paper rolls. Frequently, conversion kits are sold to accommodate various sizes of adhesive tape.

A portable stand for roll material which comprises a unitary bent and welded tube is disclosed in the Martin U.S. Pat. No. 3,847,709.

A hand-carriable apron taper is disclosed in the Waltz U.S. Pat. No. 3,630,421. Another Waltz U.S. Pat. No. 3,570,731 discloses a wheeled support for upright rolls.

The following patents are cited of general interest for various forms of roll support apparatus, the Holmes U.S. Pat. No. 1,587,234; Matthews U.S. Pat. No. 2,593,325; Petasnik U.S. Pat. No. 2,487,061; and Porter U.S. Pat. No. 2,155,769.

While various forms of paper roll and tape dispensing stands have been suggested in the prior art, there is still a need for highly efficient and economical masking stand which will accommodate various sizes of rolls of paper with positive paper and tape alignment at all times.

SUMMARY OF THE INVENTION

The present invention comprises a base member attached to a supporting member having a plurality of paper roll supporting shafts extending from the support member. A tape dispenser is attached adjacent each respective paper roll and a spring-biased pressure bar forces the tape against the paper roll and can further, serve as a cutting member for removing a select portion of the paper and tape. In the preferred embodiment, the pressure bars are separate from the removable cutting members that extend parallel to the axial length of each shaft. The respective shafts are of different length and can rotatably support a variety of widths of paper with easy access to the worker. An extension tube can be fitted to one or more of the shafts to further increase the length of the shaft to accommodate at least two sizes of paper rolls.

An alternative embodiment can be hand-carried and will support one roll of paper.

DESCRIPTION OF THE PREFERRED EMBODIMENTS

The following specification taken in conjunction with the drawings sets forth examples of the present invention in such a manner that any person skilled in the art, can make and use the invention. The embodiments of the invention disclosed herein, are the best modes contemplated by the inventor in carrying out his invention in a commercial environment, although, it should be understood that various modifications can be accomplished within the parameters of the invention.

Figure 1:
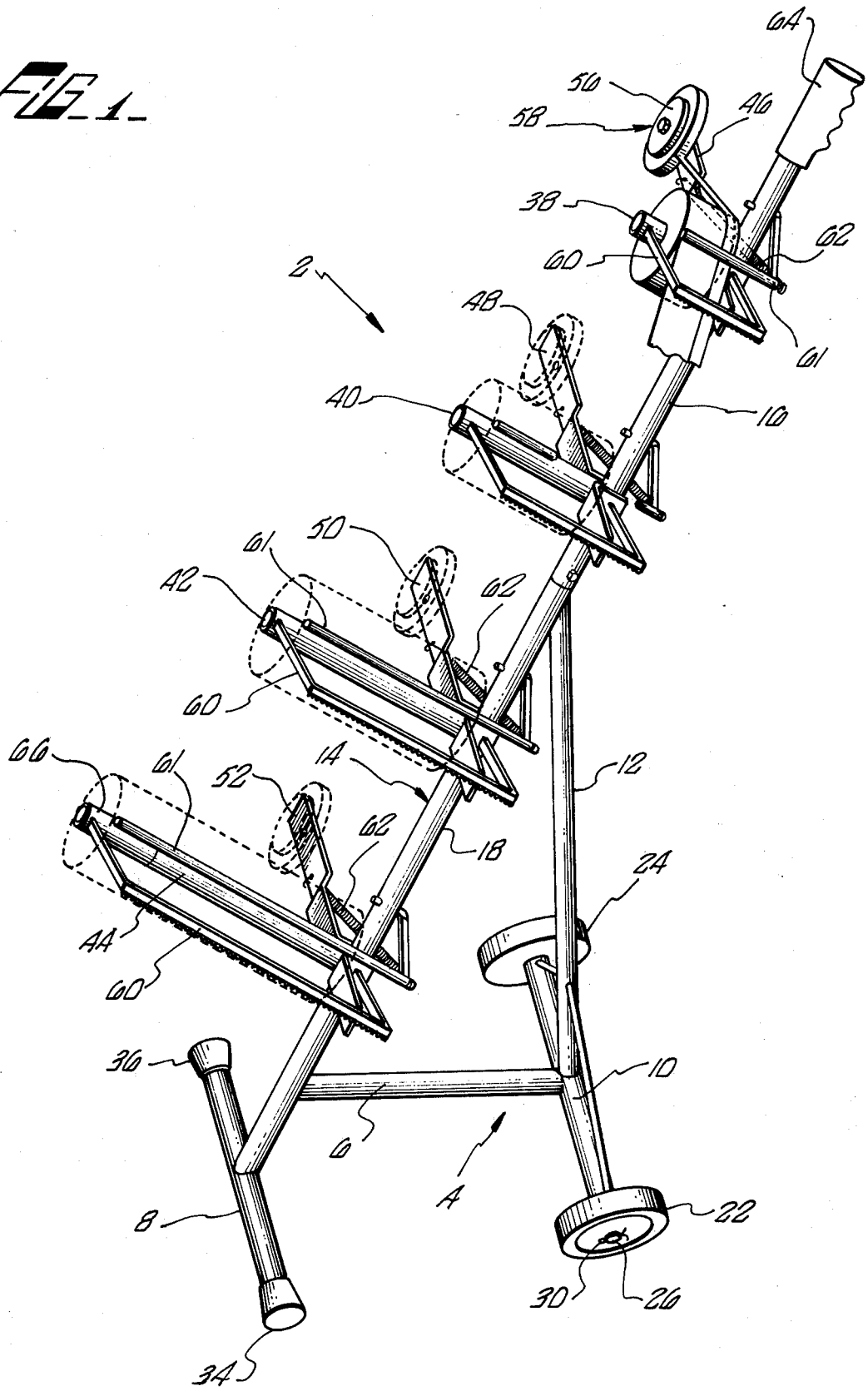
FIG. 1 is a perspective view of a paper dispensing apparatus of the present invention.
Figure 3:
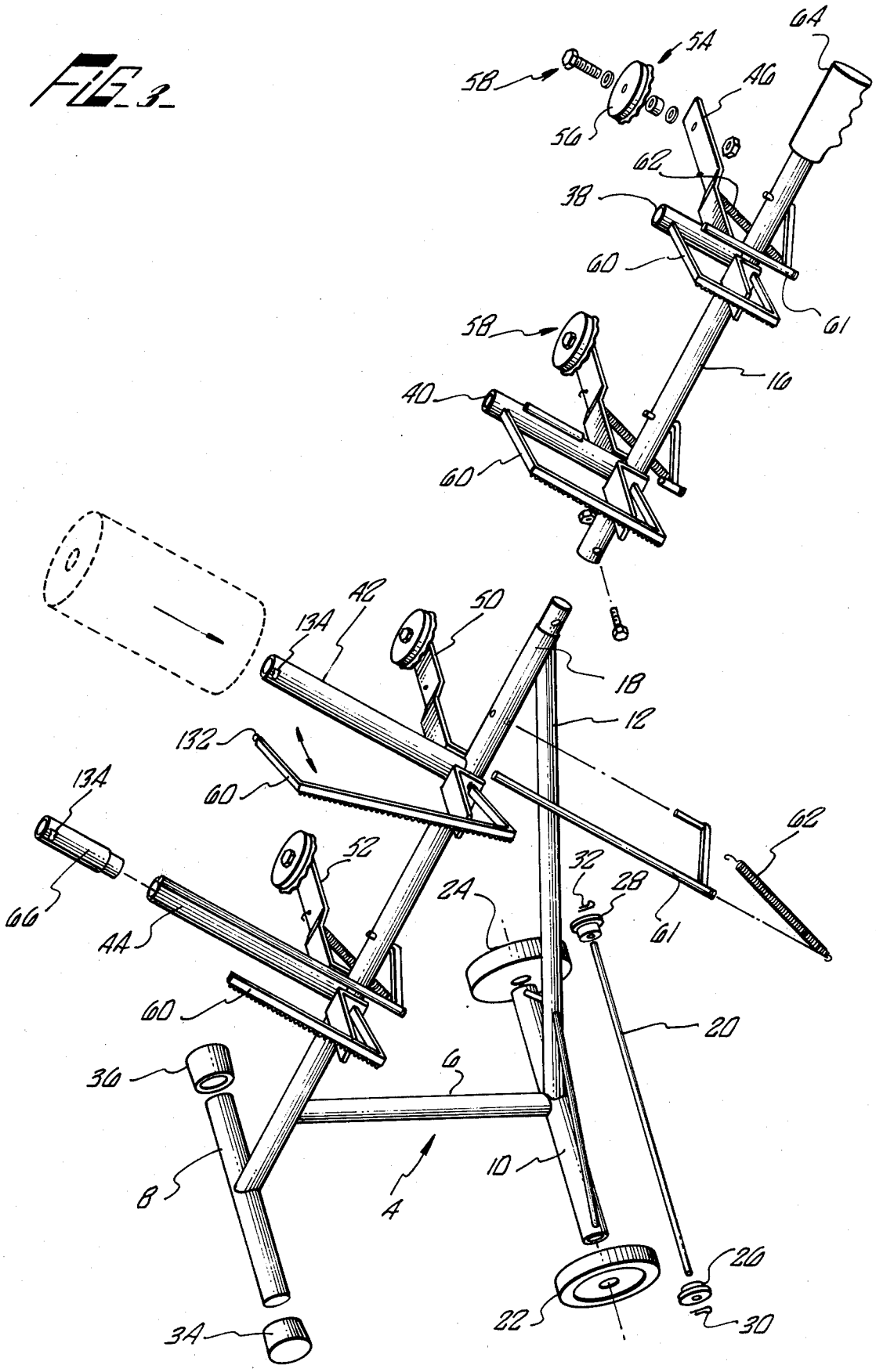
FIG. 3 is an exploded perspective view of the paper dispensing apparatus of the present invention.

Referring to FIG. 1, the first embodiment of the present invention is disclosed as a perspective view in an operative mode. As can be readily seen from FIG. 1, an operator can utilize the paper dispensing apparatus 2 to easily provide any desired length of paper from any one of four different widths of paper with adhesive tape automatically being applied to one edge of the paper. The component parts of the present invention can be more readily seen from the exploded view of FIG. 3. A base member 4 includes a set of tubular members 6, 8, 10 and 12, welded together and attached to an upward support tube 14. Support tube 14 can be bifurcated into a first upper support tube 16 and a second lower support tube 18 which are appropriately fastened together.

The rear base tube 10 contains an axle 20 connected to a pair of wheels 22 and 24, respectively. Retainer hubs 26 and 28, and pins 30 and 32, are utilized to connect the respective wheels 22 and 24 onto the axle 20. Rubber bumpers 34 and 36 are attached to either end of the front tube 8.

A series of progressively longer tubular shafts 38, 40, 42, and 44, are attached to the support tube 14 and are adapted to support rolls of paper of various lengths. The respective shafts are generally aligned in parallel and are inclined relative to the horizontal support surface so that the rolls of paper will be gravity biased against a respective stop bracket 46, 48, 50 and 52.

One arm of each stop bracket is adapted to receive a tape mounting assembly 54 which includes a spool 56 appropriately designed to hold a roll of adhesive tape. Appropriate fasteners 58 hold the spool 56 onto the stop bracket 46. Each stop bracket will have their own respective tape mounting assemblies. Other mounting arrangements for positioning the tape mounting assemblies on one side and adjacent the support shaft 14 can be utilized beside the disclosed stop brackets. The important feature is to provide the tape rolls adjacent the edge of the roll of paper when the paper roll is mounted on its appropriate shaft.

Each support shaft will have parallel aligned cutting bar 60 that is pivotally attached to the support tube 14. A spring 62 biases a pressure bar 61 towards its respective shaft and assures that the pressure bar 61 will act both as a brake in preventing the roll of paper to unwind, and further, as a pressure applicator of the adhesive tape onto the paper as the paper is being removed by the operator.

Referring to the perspective view of FIG. 1, a pivotable cutting bar 60 is adapted to be pivotally mounted on the support tube 14 and to be attached to the end of a shaft in a removable manner. In this regard, the cutting bar 60 has an enlarged head 132 which can be positioned within a dove-tail opening 134 on the shaft. Thus, it is a simple matter to pivot the cutting bar 60 free from the end of the support shaft to permit the insertion of a new roll of paper. A pressure bar 61 is biased by a spring 62 to act both as a brake and as a pressure applicator of the tape onto the adjacent roll of paper. While the various cutting bars are dimensioned to accommodate the various lengths of the supporting shafts, they all operate in the same manner and do not have to be described herein.

A handle 64 is mounted at the top of the support tube 14 and can be readily grasped by the operator to tilt the paper dispensing apparatus 2 and to cause the front base tube 8 to be lifted from the support surface so that the paper dispensing apparatus can be appropriately moved by the wheels 22 and 24 to any desired location by the operator. One or more extension tubes 66 can be utilized for slidable mounting on appropriate shafts, such as shaft 44, and thereby, increase the shaft length to accommodate large rolls of paper. Various lengths of extension tubes can adapt any particular shaft to the desired roll length that is sought to be utilized by the operator.

Figure 2:
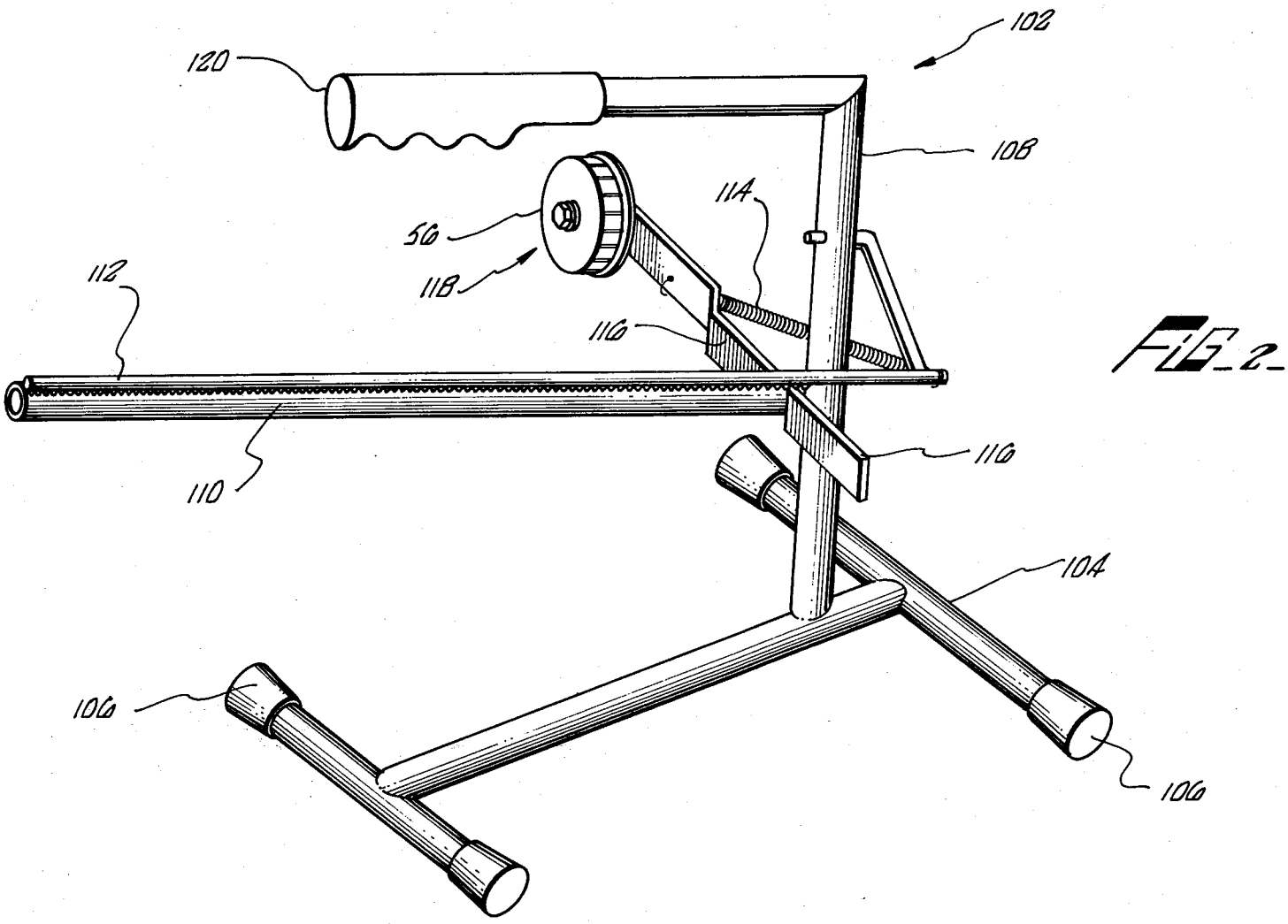
FIG. 2 is a perspective view of a hand-carried paper dispenser with a modified cutting and pressure bar.

Referring to FIG. 2, a hand-carried paper dispensing apparatus 102 is disclosed as another embodiment of the present invention and can be advantageously utilized by an operator when only one roll of paper is needed. The support base 104 comprises three tubes that are welded together to form roughly and "H" shape base. Appropriate rubber bumpers 106 are used to cap the respective ends of the tubes of the support base 104. An upward support column 108 includes a cantilevered shaft 110, which is capable of supporting the desired roll of paper. A combination cutting and pressure bar 112 is pivotally attached to the support column 108 and is biased by a spring 114 towards the shaft 110. A stop bracket 116 supports a tape mounting assembly 118 and also provides an alignment position for the paper roll. The handle 120 is positioned on that portion for the support column 108 which advantageously balances the weight of the paper dispensing apparatus 102 and its paper roll.

In operation, the operator can move the appropriate embodiment of the paper dispensing apparatus adjacent the work site and remove the desired length of adhesive taped paper to be used as an apron in an automobile painting job. With the embodiments of FIGS. 1 and 3, the operator has an advantageous selection of the right width of paper for each appropriate application. This insures an economy of paper and a fast and efficient way of having paper available. Paper rolls and tape rolls can be easily loaded and the paper edge and tape will be aligned at all times.

The embodiments with the pressure bar 61 and cutting and pressure bar 112 provide a positive pressure application of tape to the edge of the paper. Since they are spring biased they will follow the paper roll as it shrinks in diameter during use and also act as a brake. Thus, the tape can be positively applied without requiring extra guides and rollers to provide the desired pressure application.

The parallel shafts on a single support member provide a heretofore unknown advantage of an easy application of various sizes of paper at the choice of operators with an easy changing of paper rolls.

While a preferred embodiment of the present invention has been described hereinabove, it is intended that all matter contained in the above description and shown in the accompanying drawings be interpreted as illustrative and not in a limiting sense and that all modifications, constructions, and arrangements which fall within the scope and spirit of the invention may be made.

What is claimed is:

1. A tape and paper dispensing apparatus for rolls of paper comprising:

a base member;

a support member attached to the base member;

a plurality of shafts, each having a different length and attached at only one end to the support member and extending outward from the support member to respectively receive and support different widths of paper rolls so that the axis of each shaft forms an acute angle to the plane supporting the base member; and means for applying an adhesive tape to an edge of each roll of paper including a pressure bar forcing the tape against the roll edge.

2. The invention of claim 1 further including a cutting bar extending across the width of each paper roll.

3. The invention of claim 2 further including a pivotal mounting for the cutting bar to permit it to be moved away from the shaft.

4. The invention of claim 2 further including means for mounting the cutting bars at both ends of the shafts.

5. The invention of claim 2 wherein the means for applying adhesive tape includes a plurality of tape rolls mounted respectively adjacent each shaft.

6. The invention of claim 5 wherein the cutting bar is pressure biased directly against the roll of paper.

7. The invention of claim 1 further including at least one extension tube adapted to being connected to at least one shaft for extending the effective axial length to support a roll of paper longer than the shaft.

8. The invention of claim 1 further including a plurality of cantilevered pressure bars pivotally mounted directly on the support member and resiliently biased against their respective rolls of paper to provide a positive force on each tape for application to the paper.

9. The invention of claim 8 wherein the base member includes a front support member and a rear support member having a pair of wheels.

10. A paper dispensing apparatus for a plurality of rolls of paper comprising:

a base member having a front and rear support member;

wheel means attached to only the rear support member;

a support member attached to the base member and extending upward from the base member;

a plurality of shafts of different lengths cantilevered outward from the support member to support respective different widths of paper rolls;

a plurality of pivotally mounted pressure bars extending adjacent each shaft to bear against their respective paper rolls and relatively movable transverse to each respective shaft;

means for applying an adhesive tape to the edge of each paper roll, including a pressure bar forcing a tape against the edge of a paper, and handle means attached to the support member for rotating the base member about the wheel means to transport the paper dispensing apparatus supported only by the wheel means.

* * * * *